US005209244A

United States Patent [19]

Adkison

[11] Patent Number: 5,209,244

[45] Date of Patent: May 11, 1993

[54] METHOD OF CLEANING METAL MESH GLOVES

[75] Inventor: Frank L. Adkison, Winfield, Iowa

[73] Assignee: Oscar Mayer Foods Corporation, Madison, Wis.

[21] Appl. No.: 911,258

[22] Filed: Jul. 7, 1992

Related U.S. Application Data

[60] Division of Ser. No. 759,101, Sep. 6, 1991, abandoned, which is a continuation of Ser. No. 591,929, Oct. 19, 1990, abandoned.

[51] Int. Cl.[5] ..... B08B 1/00; A47L 25/00

[52] U.S. Cl. ..... 134/6; 15/77; 15/88.3; 134/42

[58] Field of Search ..... 134/6, 42; 15/39, 40, 15/72, 74, 77, 88.1, 88.2, 88.3, 88.4, 102

[56] References Cited

U.S. PATENT DOCUMENTS

| | | | |
|---|---|---|---|
| 1,503,719 | 8/1924 | Stelter | 15/39 X |
| 1,907,152 | 5/1933 | Fielding | 15/74 |
| 2,228,443 | 1/1941 | Costa | 15/39 |
| 2,269,807 | 1/1942 | Buckley | 15/77 |
| 2,334,714 | 11/1943 | Knight | 15/88.3 X |
| 2,546,288 | 3/1951 | Zucker | 15/40 X |
| 3,081,471 | 3/1963 | Newell | 15/88.3 |
| 3,204,271 | 9/1965 | Kingston | 15/40 X |
| 3,284,828 | 11/1966 | Jennings et al. | 15/88.3 |
| 3,761,984 | 10/1973 | Hauschild et al. | 15/88.3 |
| 3,872,534 | 3/1975 | Hoag | 15/88.3 X |
| 4,541,138 | 9/1985 | Varrial | 15/88 X |
| 4,733,421 | 3/1988 | Kuersteiner | 15/88.3 |
| 4,739,533 | 4/1988 | Lee | 15/88.3 X |
| 5,067,193 | 11/1991 | Thomas | 15/88.3 |

FOREIGN PATENT DOCUMENTS

| | | | |
|---|---|---|---|
| 674645 | 4/1939 | Fed. Rep. of Germany | 15/88.3 |
| 2017712 | 11/1971 | Fed. Rep. of Germany | 15/39 |
| 56431 | 6/1944 | Netherlands | 15/88.3 |

*Primary Examiner*—Edward L. Roberts
*Assistant Examiner*—Charles Cooley
*Attorney, Agent, or Firm*—Lockwood, Alex, Fitzgibbon & Cummings

[57] ABSTRACT

A method for cleansing metal mesh gloves to remove particles of meat or the like embedded within the metal mesh of the gloves includes elongated rollers which preferably counter-rotate with respect to each other and define an entry slot area within which the gloves are inserted for cleansing.

11 Claims, 2 Drawing Sheets

METHOD OF CLEANING METAL MESH GLOVES

This application is a division, of application Ser. No. 759,101, filed Sept. 6, 1991, now abandoned which application was a continuation of application Ser. No. 591,929, filed Oct. 2, 1990, now abandoned.

BACKGROUND OF THE DESCRIPTION OF THE INVENTION

The present invention generally relates to an apparatus and method for cleansing metal gloves of the type that are used in the meat processing industry or the like. More particularly, the invention relates to a cleansing apparatus and method having at least two generally parallel elongated rollers or brushes. A glove is passed at least partially into an entry slot area where the rolls counter-rotatingly engage the glove to cleanse it, preferably in cooperation with the flow of cleansing fluid directed onto at least one of the rollers.

In the meat packing and meat processing industries, as well as in related industries such as fish processing and the like, various cutting operations are performed either manually or semi-manually. In those instances, safety concerns dictate that the operator of the cutting equipment or device wear gloves that are made of a metal mesh material. While this metal mesh material does provide an extremely advantageous measure of safety, the metal mesh structure does create a difficult cleaning problem. Because of the expense of metal mesh gloves, it is undesirable to discard them until after they have been worn for long periods of time. Because the gloves are constantly in contact with food, it is important that they be effectively cleaned on a regular basis. Effective cleaning includes having meat and fish particles and the like displaced from out of the many crevices and spaces between the metal strips or fibers which make up the metal mesh gloves. This task is made more difficult by virtue of the fact that the meat or fish particles or the like tend to be or become sticky and thus have a strong tendency to remain lodged within the crevices or spaces.

In the past, high-pressure jets or flows of fluids such as air or pressurized water have been utilized in an attempt to force the particles out of the gloves by having the high pressure fluid dislodge the particles from these crevices. Often these cleaning operations are the responsibility of the user of the gloves, and there is a tendency for each user to use whatever means are available, such as sources of house air or pressurized water directed through high pressure nozzles, in an attempt to dislodge particles from within the mesh. Usually, these cleaning operations also include detergent cleansing and treatment with a chlorine solution or the like. Unless the meat particles are effectively removed, however, these liquid cleaning operations will be rendered potentially less effective if substantial quantities of meat or fish particles or the like remain in the groves at, for example, the time of treatment with a chlorine solution.

Accordingly, there is a need for an apparatus and method for cleansing metal mesh gloves or the like. It is preferred that such an apparatus be capable of being easily operated by the user of the metal mesh gloves and that the operation proceed in a safe and efficient manner. Also, while the use of high pressure fluids does have significant potential and has achieved a certain amount of success in the past, high pressure fluids do create a complication in having to provide the high pressure source and in having to handle the high pressure fluid during the cleansing operation. High pressure devices can lead to additional handling problems, such as how to handle particulate debris which can become airborne when subjected to a high pressure fluid. Therefore, it would be advantageous if an approach can be taken which avoids the need for high pressure fluids.

In summary, the metal mesh glove cleansing apparatus and method according to this invention includes a plurality of generally counter-rotating elongated roller brushes which provide an entry slot area for receiving metal mesh gloves. This entry slot area is provided and arranged such that the user of the metal mesh gloves can easily insert the gloves into the entry slot area. Then, the cleansing apparatus directs low-pressure fluid such as water to the entry slot area, and the combination of the fluid with the counter-rotating elongated roller members effectively removes the meat or fish particles or the like from the intersticies of the metal mesh glove, at which time the glove is suitable for treatment with a chlorine solution or the like in order to treat the thus cleansed metal in order to effectively reduce the chance of contamination or the onset of microbial growth.

It is accordingly a general object of the present invention to provide an improved apparatus and method for cleansing metal mesh gloves.

Another object of this invention is to provide an improved means and method for removing particulate food materials from metal mesh gloves used in handling these types of materials at processing plants. Another object of the present invention is to provide an improved apparatus and method which accomplishes cleansing of metal mesh gloves and the like without requiring the use of high pressure fluid sources.

Another object of the present invention is to provide means and method for washing steel mesh gloves and the like in a very short time period and with minimal effort on the part of the operator of the device.

These and other objects, features and advantages of the present invention will be clearly understood through a consideration of the following detailed description.

BRIEF DESCRIPTION OF THE DRAWINGS

In the course of this description, reference will be made to the attached drawings, wherein.

DESCRIPTION OF THE PARTICULAR EMBODIMENTS

Figure 1:
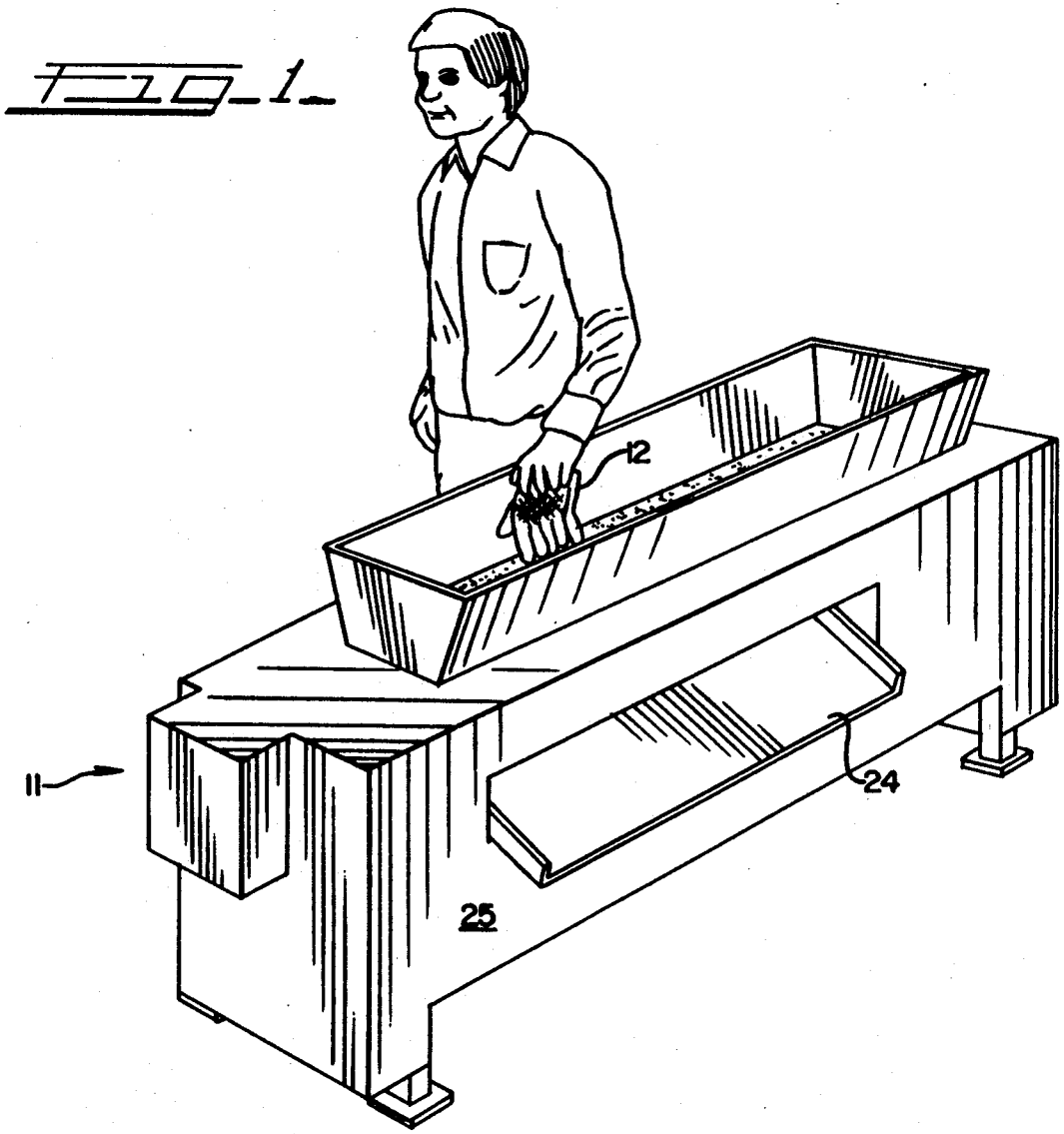
FIG. 1 is a perspective view of an apparatus in accordance with this invention, illustrating the use thereof.
Figure 4:
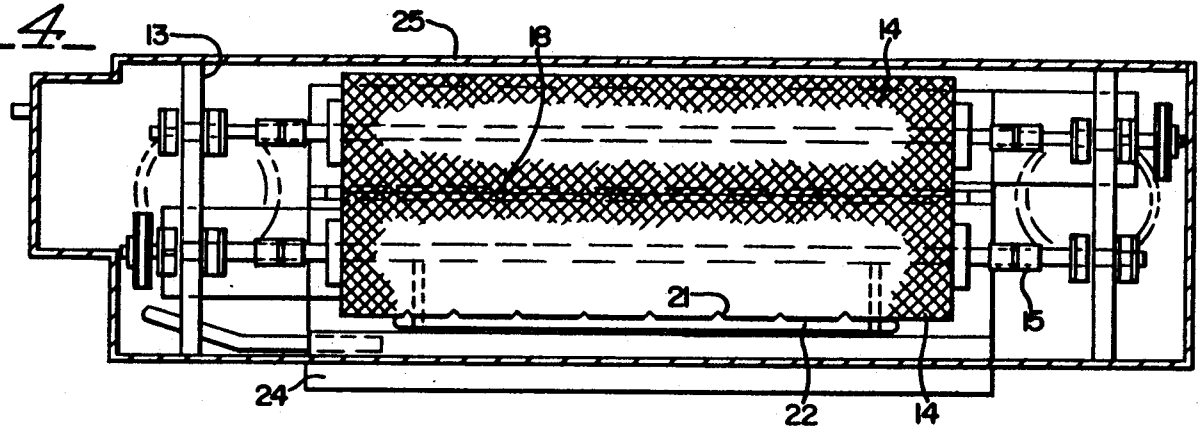
FIG. 4 is a longitudinal, horizontal cross-sectional view of the apparatus illustrated in FIG. 1.
Figure 3:
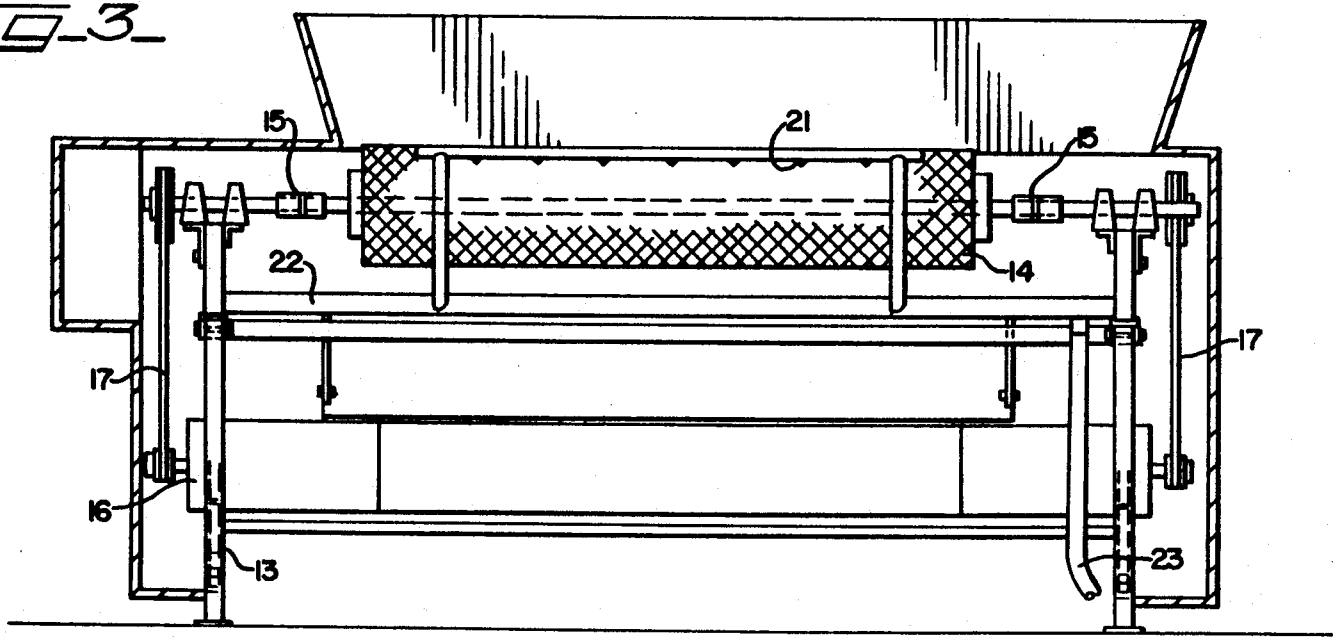
FIG. 3 is a longitudinal, vertical cross-sectional view of the apparatus illustrated in FIG. 1.

The device according to this invention and for performing the method thereof is generally illustrated at 11 in FIG. 1. Metal mesh gloves 12 are inserted into the device by a worker who suspends the gloves in an appropriate manner, such as by holding same by a glove wrist band or by any other convenient means such as by using a grasping device. Alternatively, the gloves 12 can remain on the worker's hands during the washing operation, in which event the gloved hands themselves are inserted directly into the device. In a typical operation, the gloves 12 are first dipped into a soap solution (not shown), they are cleansed within the device 11, and then they are dipped into a chlorine solution (not shown) which typically contains about 50 ppm of chlorine.

Device 11 includes a frame assembly 13 for supporting the various components of the device 11.

Elongated rollers 14 are mounted on the frame assembly 13 for rotation about substantially horizontal parallel axes and in a manner such that the elongated rollers 14 are easily removable for cleaning and replacement as needed. A typical arrangement in this regard is to incorporate spring loaded shaft couplers 15. Suitable means are provided for driving each elongated roller. A suitable arrangement in this regard includes the drive motors 16 and V-grooved drive belts 17.

Figure 2:
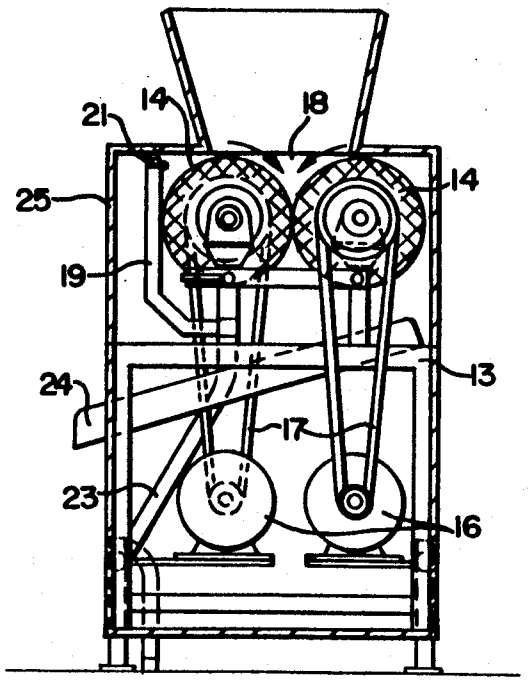
FIG. 2 is a transverse cross-sectional view of the apparatus illustrated in FIG. 1.

It is important that the elongated rollers 14 be counter-rotating and preferably in the orientation of the arrows shown in FIG. 2. With this arrangement, the elongated rollers 14 define an entry slot area 18 in which inwardly and downwardly oriented cleansing forces are exerted on each glove 12 present at the entry slot area 18. The entry slot area 18 is located generally above and between elongated rollers 14.

It is preferred that each elongated roller 14 be in the form of a roller brush having generally radially extending nylon filament bristles or the like. It has been determined that, with elongated rollers of this general type, excellent and efficient cleansing is carried out when the counter-rotating elongated rollers each rotate at a speed of between about 400 and about 500 revolutions per minute. This has been found to be especially effective for removing poultry and red meat particles from steel mesh gloves The cleansing action of the counter-rotating elongated rollers 14 is enhanced by the inclusion of a low-pressure fluid supply assembly 19 which directs a fluid such as house water onto at least one of the rotating elongated rollers. A typical fluid supply assembly includes a plurality of exit openings or low-pressure nozzles 21, internal conduits 22 and a supply conduit 23 for communication with a desired supply of fluid (not shown) to be directed out of the exit openings 21. The low pressure nozzles 21 are located close to the upper circumferential edge of at least one elongated roller 14.

For convenience, a discharge chute 24 is provided to collect the cleansing fluid discharged from the elongated rollers 14. Fluid overflow and the like is contained within the device 11 by providing removable stainless steel covers 25 which can be periodically disassembled and cleaned in accordance with standard industry procedures.

Use of the device according to the present invention, when initiated by immersion within a washing or detergent solution and when completed by immersion within a solution of chlorine or the like, accomplishes a cleansing function which is superior to previously used high pressure operations. Also, since the device takes a low-pressure approach, substantially less water or other cleansing fluid is needed than when high-pressure procedures are followed. In addition, the device is easily used, and a pair of steel mesh gloves can be fully cleansed within approximately three seconds. The invention significantly minimizes the spread of any possible contamination within a food processing plant such as a turkey processing plant.

It will thus be seen that the present invention provides a new and useful device and method for cleansing metal mesh gloves, which device has a number of advantageous characteristics, including those pointed out herein and others which are inherent in the invention. Preferred embodiments of the invention have been described by way of example, and it is anticipated that modifications may be made to the described form without departing from the spirit of the invention or the scope of the appended claims.

I claim:

1. A method of cleansing a metal mesh glove of the type used in the meat processing industry and which is constructed of metal strips having crevices and spaces therebetween which have particles of meat, fish and the like embedded therein, said method comprising:

rotating a pair of elongated rollers toward and in counter-rotation to each other about elongate axes to define an entry slot between said rollers, said rollers and axes extending substantially parallel to each other, and said rollers comprising a plurality of bristles extending generally radially therefrom;

providing a flow of cleansing fluid onto at least one of the rotating rollers; and removing the particles of meat, fish and the like embedded in the crevices and spaces in the metal mesh glove by inserting the metal mesh glove into the entry slot between the rollers so that the rollers simultaneously exert inwardly and downwardly directed forces on the metal mesh glove, and said cleansing fluid flushes and removes the particles from the glove and the rollers.

2. The method of claim 1, wherein said axes are substantially horizontal.

3. The method of claim 2, wherein the cleansing fluid is provided to the roller adjacent its upper portion.

4. The method of claim 2, wherein the cleansing fluid includes water which is provided at a low pressure to the roller adjacent its upper portion.

5. The method of claim 4, wherein the bristles are nylon.

6. The method of claim 1, wherein the bristles are nylon.

7. The method of claim 1, wherein said flow of cleansing fluid is provided to the roller adjacent a location at which the roller rotates into the entry slot.

8. The method of claim 7, wherein the cleansing fluid is at a low pressure.

9. The method of claim 8, wherein the cleansing fluid includes water.

10. The method of claim 1, wherein the cleansing fluid is at a low pressure.

11. The method of claim 10, wherein the cleansing fluid includes water.

* * * * *

UNITED STATES PATENT AND TRADEMARK OFFICE

CERTIFICATE OF CORRECTION

PATENT NO. : 5,209,244

DATED : May 11, 1993

INVENTOR(S) : Frank L. Adkison

It is certified that error appears in the above-indentified patent and that said Letters Patent is hereby corrected as shown below:

On the title page:

In the Related U.S. Application Data, "October 19, 1990" should read --October 2, 1990--.

Col.1, line 4, delete the comma "," after "division"; line 5, insert a comma --,-- after "abandoned".

Col. 2, line 30, "Another" should start a new paragraph.

Col. 4, line 17, "cleansing" should read --cleaning--.

Signed and Sealed this

Eleventh Day of April, 1995

Bruce Lehman

*Attest:*

BRUCE LEHMAN

*Attesting Officer*

*Commissioner of Patents and Trademarks*